US009414667B1

(12) United States Patent
Tate

(10) Patent No.: US 9,414,667 B1
(45) Date of Patent: Aug. 16, 2016

(54) GROUND-PENETRATING UTILITY ARTICLE HOLDING DEVICE AND METHOD

(71) Applicant: Brandon Tate, Greenville, NC (US)

(72) Inventor: Brandon Tate, Greenville, NC (US)

( * ) Notice: Subject to any disclaimer, the term of this patent is extended or adjusted under 35 U.S.C. 154(b) by 0 days.

(21) Appl. No.: 14/643,653

(22) Filed: Mar. 10, 2015

Related U.S. Application Data

(60) Provisional application No. 61/950,240, filed on Mar. 10, 2014.

(51) Int. Cl.
*F16M 13/00* (2006.01)
*A45F 3/44* (2006.01)
*F16M 13/02* (2006.01)

(52) U.S. Cl.
CPC . *A45F 3/44* (2013.01); *F16M 13/02* (2013.01)

(58) Field of Classification Search
USPC ..... 248/530, 156
See application file for complete search history.

(56) References Cited

U.S. PATENT DOCUMENTS 2,084,239 A * 6/1937 Bradford ..... E02D 5/801 119/788
2,628,797 A * 2/1953 Campomar ..... E04H 12/2223 116/173
3,519,234 A * 7/1970 Matson ..... E01F 9/0117 144/195.5
4,252,472 A * 2/1981 Moraly ..... E04H 17/263 173/126
4,656,774 A * 4/1987 Terrill ..... A01K 97/10 248/545
4,700,502 A * 10/1987 McFarland ..... A01K 97/10 206/315.11
4,854,069 A * 8/1989 Smith ..... A01K 97/10 248/538
4,866,873 A * 9/1989 Van Valkenburg ..... A01K 97/10 248/538
5,088,681 A * 2/1992 Procaccianti ..... E04H 12/2223 248/156
5,097,912 A * 3/1992 Bowers ..... B25D 1/16 173/118
5,207,402 A * 5/1993 Berry-Tremmel ..... G09F 7/18 248/156
5,488,798 A * 2/1996 Beachel ..... A01K 97/10 248/530
5,564,822 A * 10/1996 Golden ..... A45F 3/44 362/401

(Continued)

*Primary Examiner* — Monica Millner
(74) *Attorney, Agent, or Firm* — Schwartz Law Firm, P.C.

(57) ABSTRACT

An article holding device includes an elongated rigid ground shaft with a radiating helical surface, a generally C-shaped crank shaft fixed to the ground shaft, and an elongated hand shaft fixed to the crank shaft opposite the ground shaft. The crank shaft comprises a crank handle laterally offset from and substantially parallel to the ground shaft. The crank handle includes a first swivel sleeve adapted for being grasped by a first hand of a user. The hand shaft includes a second swivel sleeve adapted for being grasped by a second hand of the user. The outdoor utility article is held adjacent a free end of the hand shaft.

17 Claims, 6 Drawing Sheets

U.S. PATENT DOCUMENTS 5,639,057 A * 6/1997 Yeomans ..... A01K 97/10 248/156
5,687,946 A * 11/1997 Cho ..... A45B 11/00 248/156
5,699,864 A * 12/1997 Dvorak ..... E04H 12/2215 173/128
5,881,495 A * 3/1999 Clark ..... A01G 9/12 135/118
5,881,978 A * 3/1999 Rust ..... G09F 7/18 109/52
5,890,260 A * 4/1999 Gaunt ..... B25G 1/10 16/436
D448,131 S * 9/2001 Ver Haar ..... D32/54
6,655,648 B2 * 12/2003 Harris ..... F16M 7/00 220/475
6,702,239 B2 * 3/2004 Boucher ..... A01G 9/122 248/125.8
D546,659 S * 7/2007 Smith ..... D8/313
D616,950 S * 6/2010 Hersee ..... D21/682
7,934,567 B1 * 5/2011 Madey ..... E04H 17/263 173/132
8,474,773 B2 * 7/2013 Hull ..... A45F 3/44 248/156
2002/0166280 A1 * 11/2002 O'Grady, Sr. ..... A01K 97/10 43/21.2
2006/0060310 A1 * 3/2006 Haugen ..... E04H 12/2215 160/135
2006/0185206 A1 * 8/2006 Du Bose ..... G09F 7/18 40/610
2007/0039219 A1 * 2/2007 Wallace ..... G09F 7/18 40/645
2008/0271388 A1 * 11/2008 Bayly ..... E02D 5/805 52/160
2010/0044661 A1 * 2/2010 Weiner ..... E01F 9/0117 256/1
2011/0253876 A1 * 10/2011 Odell ..... E04H 12/2215 248/530
2014/0332645 A1 * 11/2014 Brooks ..... A01M 31/06 248/156

* cited by examiner

GROUND-PENETRATING UTILITY ARTICLE HOLDING DEVICE AND METHOD

TECHNICAL FIELD AND BACKGROUND OF THE INVENTION

This invention relates broadly and generally to a ground-penetrating utility article holding device and method. In one exemplary embodiment, the present disclosure comprises a device designed for use at the beach to readily and conveniently hold a beach article, such as an umbrella, table top, fishing rod, or the like.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises an article holding device including an elongated rigid ground shaft with a radiating helical (or advancing spiral) surface, a generally C-shaped crank shaft fixed to the ground shaft, and an elongated hand shaft fixed to the crank shaft opposite the ground shaft. The crank shaft comprises a crank handle laterally offset from and substantially parallel to the ground shaft. The crank handle includes a first swivel sleeve adapted for being grasped by a first hand of a user. The hand shaft includes a second swivel sleeve adapted for being grasped by a second hand of the user. The user manually rotates the ground shaft by grasping the first swivel sleeve of the crank handle and turning the crank shaft, while simultaneous grasping and holding the second swivel sleeve of the hand shaft, thereby driving the helical surface of the ground shaft into and through a penetrable ground surface. Means adjacent a free end of the hand shaft are provided for holding an outdoor utility article.

The term "radiating helical surface" refers broadly herein to any radially projecting twisted, angled, or spirally-extending surface capable of advancing the ground end of the exemplary device (when the device is turned) into and through a ground surface.

According to another exemplary embodiment, the ground shaft comprises a plurality of angled blades radiating from a central hub, such that each blade forms part of the radiating helical surface. In this embodiment, the exemplary "radiating helical surface" has a propeller-type design which may be either integrally molded with the ground shaft or separately permanently attached to a distal end of the ground shaft.

According to another exemplary embodiment, the ground shaft has a substantially closed pointed end.

According to another exemplary embodiment, the means for holding the utility article comprises an elongated substantially hollow extension shaft adjacent the hand shaft, and defining an open end for receiving a mounting post of the utility article.

According to another exemplary embodiment, the ground shaft, crank shaft, and hand shaft are integrally joined together, and rotate as single unit upon manual rotation of the crank shaft.

According to another exemplary embodiment, the first swivel sleeve is formed independent of the crank handle, such that the crank shaft turns freely relative to the first swivel sleeve.

According to another exemplary embodiment, the second swivel sleeve is formed independent of the hand shaft, such that the hand shaft turns freely relative to the second swivel sleeve.

According to another exemplary embodiment, the hand shaft is substantially hollow, and defines an open end for receiving a mounting post of the outdoor utility article.

According to another exemplary embodiment, the ground shaft, crank shaft, and hand shaft are fabricated of a rigid synthetic plastic polymer.

In another exemplary embodiment, the present disclosure comprises an outdoor utility article used in combination with an article holding device, as described further herein. The utility article comprises an elongated rigid mounting post. The article holding device is adapted for engaging the mounting post to support the utility article above a ground surface.

According to another exemplary embodiment, the outdoor utility article is selected from a group consisting of an umbrella, a table top, and a fishing rod holder.

In yet another exemplary embodiment, the present disclosure comprises a method using an article holding device, as described further herein, for holding an outdoor utility article above a penetrable ground surface. The method includes vertically positioning the article holding device such that the ground shaft points downward at the ground surface. A first swivel sleeve of the crank shaft is then grasped by the user with a first hand. With the second hand, the user simultaneously grasps a second swivel sleeve of the hand shaft. Using the first hand, the user manually turns the crank shaft thereby driving the helical surface of the ground shaft into and through the ground surface. A mounting post of the outdoor utility article is then positioned adjacent the hand shaft to support the utility article above the ground surface.

BRIEF DESCRIPTION OF THE DRAWING

Exemplary embodiments of the present invention will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
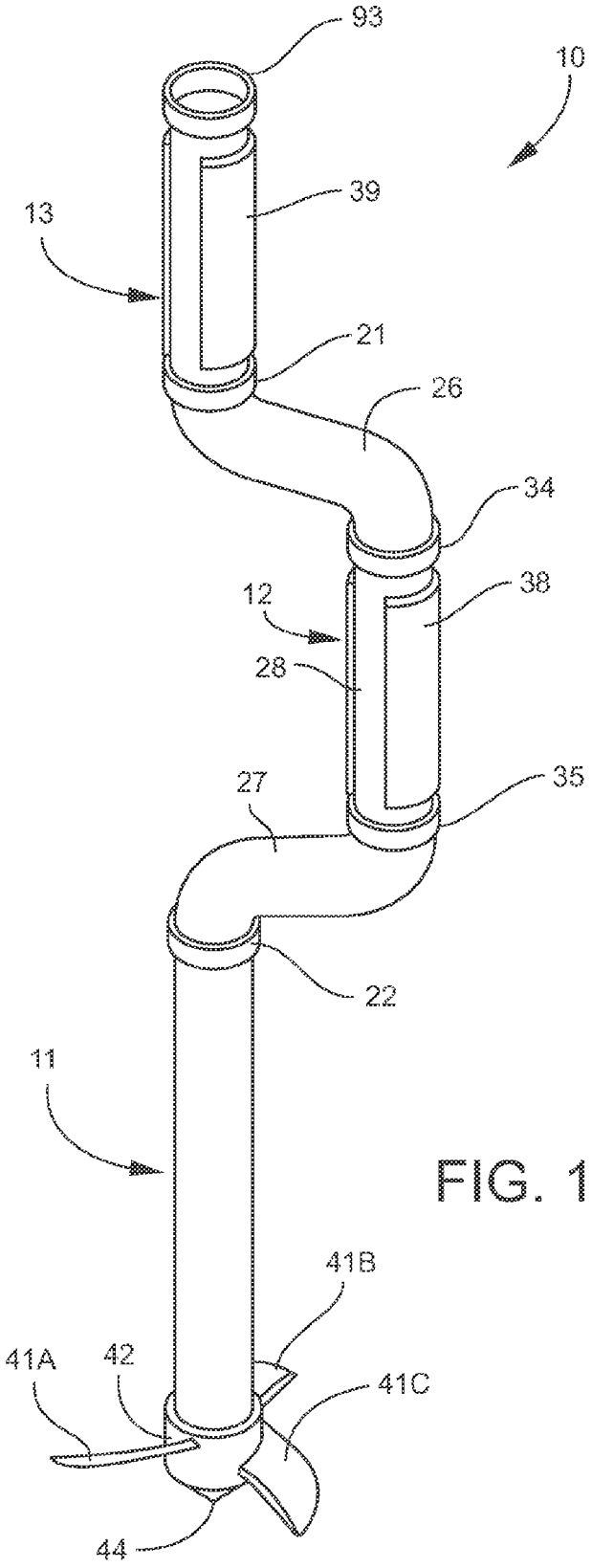
FIG. 1 is a perspective view of a utility article holding device according to one exemplary embodiment of the present disclosure.
Figure 4:
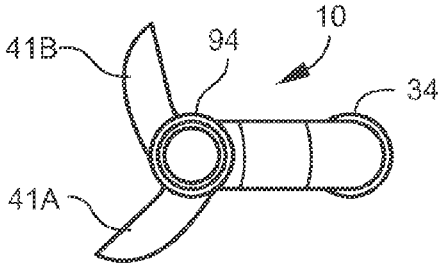
FIG. 4 is a top plan view of the exemplary article holding device.
Figure 7:
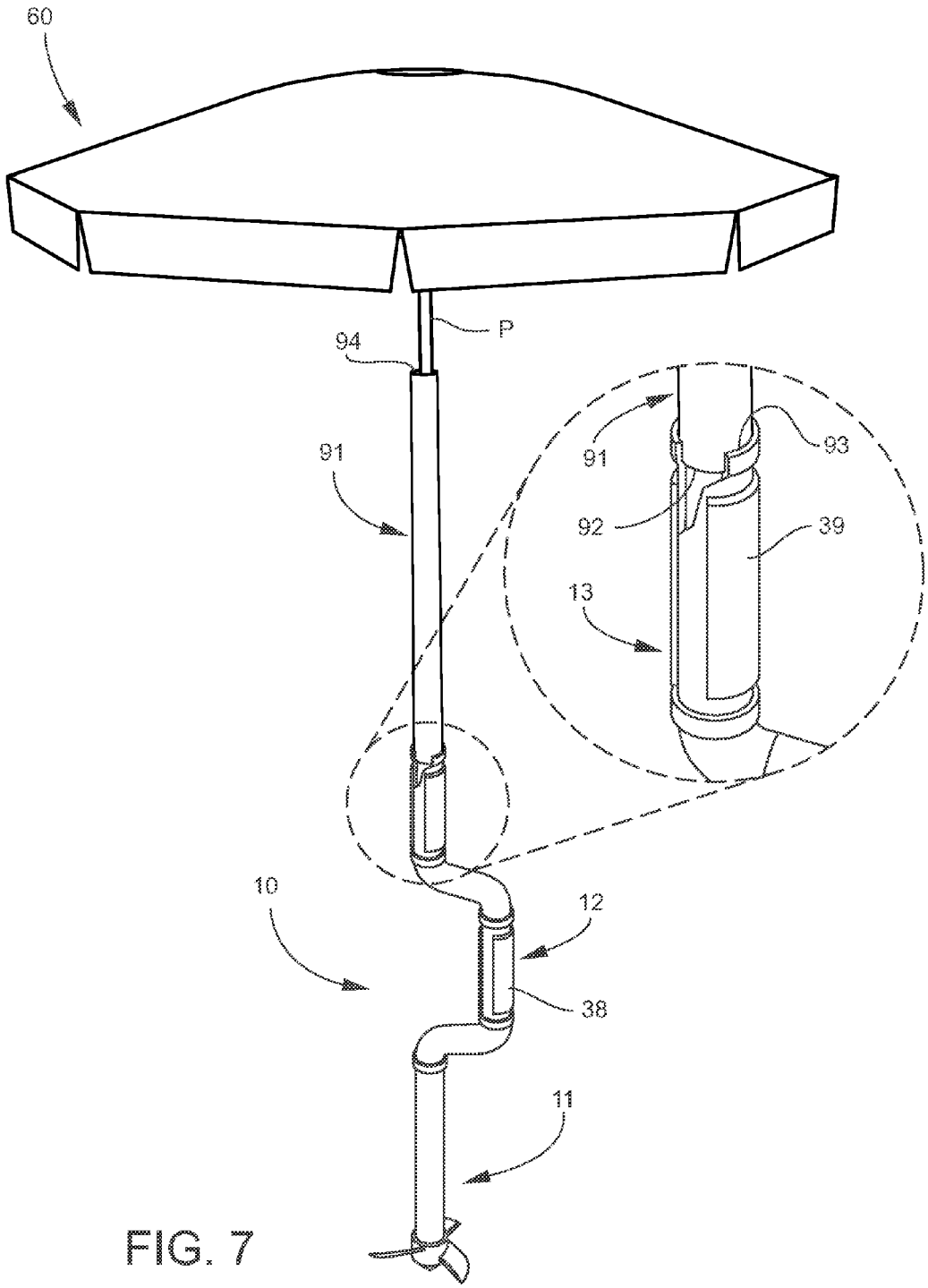
FIGS. 7, 8, and 9 illustrate various exemplary applications of the article holding device in combination with a beach umbrella, table, and fishing rod, respectively.
Figures 8, 9:
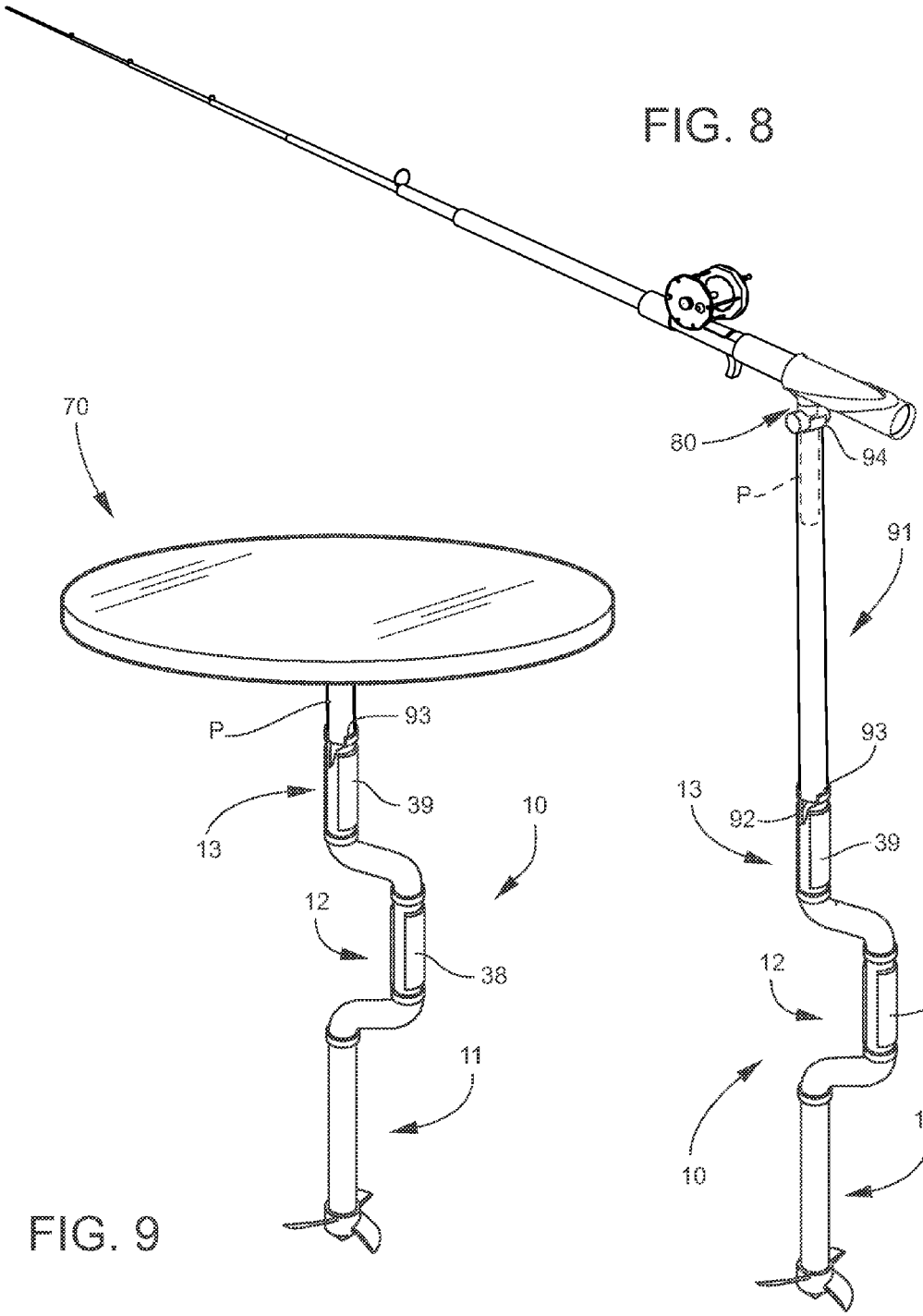

Referring now specifically to the drawings, a ground-penetrating article holding device according to one exemplary embodiment of the present disclosure is illustrated in FIG. 1, and shown generally at reference numeral 10. While various exemplary applications of the present device 10 are illustrated in FIGS. 7-9 and described further below, the device 10 may be used in a wide variety of other activities and events, and in any environment comprising a penetrable ground surface including a sand beach, campsite, construction site, snow and ice surfaces, grass yards, dirt and gravel roads, and others. In other exemplary applications, the present device 10 may be used for holding flag posts, sign posts, distance markers at run races, posts for a volleyball net or the like, tent poles, and other elongated article supports and objects.

Referring to FIGS. 1-5, the exemplary article holding device 10 incorporates an elongated rigid ground shaft 11, a generally C-shaped crank shaft 12 fixed to the ground shaft 11, and an elongated hollow hand shaft 13 fixed to the crank shaft 12 opposite the ground shaft 11. The shafts 11, 12, 13 are formed of a tubular lightweight PVC material or other synthetic polymer, and are integrally joined together using an adhesive, screws, rivets, or other hardware. In one embodiment best shown in FIGS. 1, 2 and 5, the crank shaft 12 has slightly enlarged female ends 21, 22 designed to closely receive complementary proximal male ends 23 and 24 of the ground shaft 11 and hand shaft 13, respectively.

Figure 2:
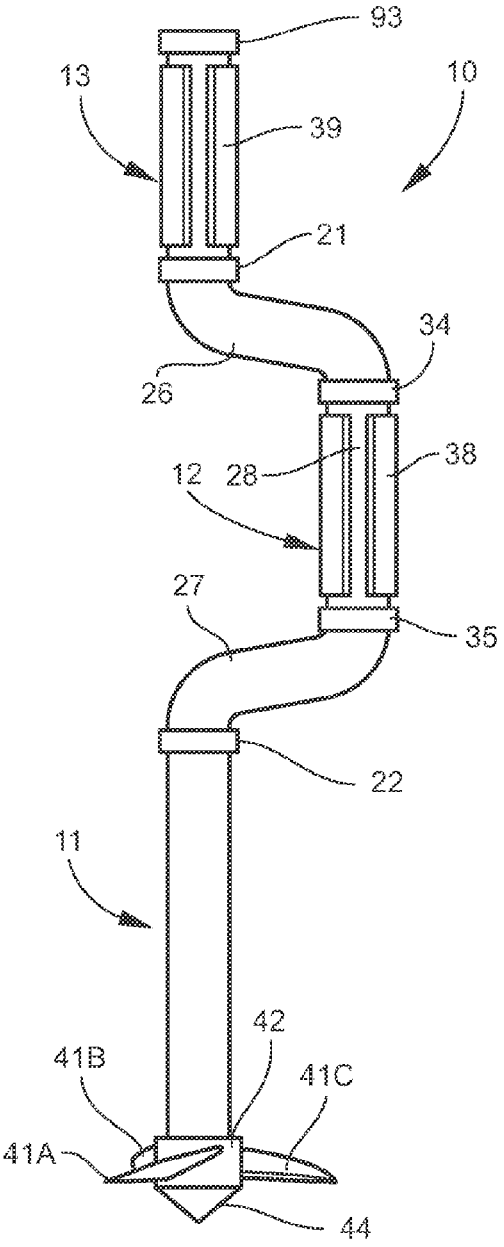
FIG. 2 is a first elevational view of the exemplary article holding device.
Figure 3:
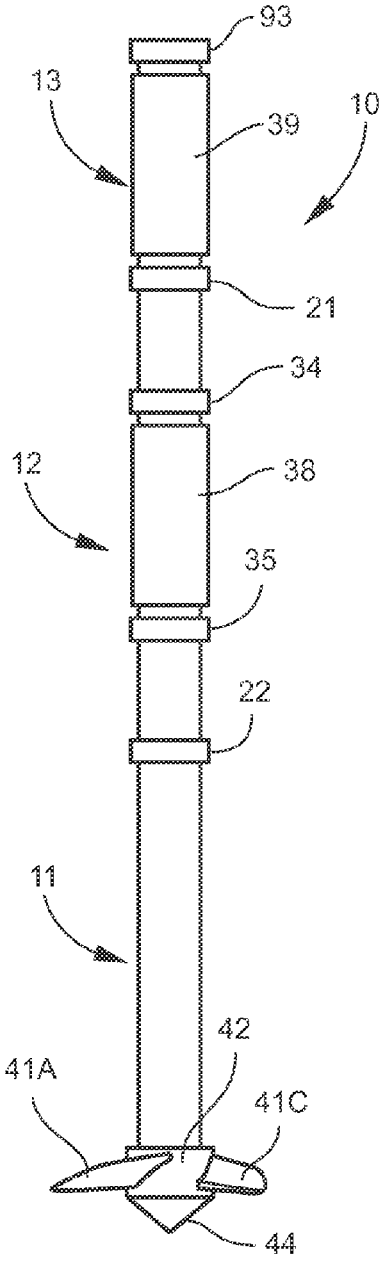
FIG. 3 is a second elevational view of the exemplary article holding device.
Figure 5:
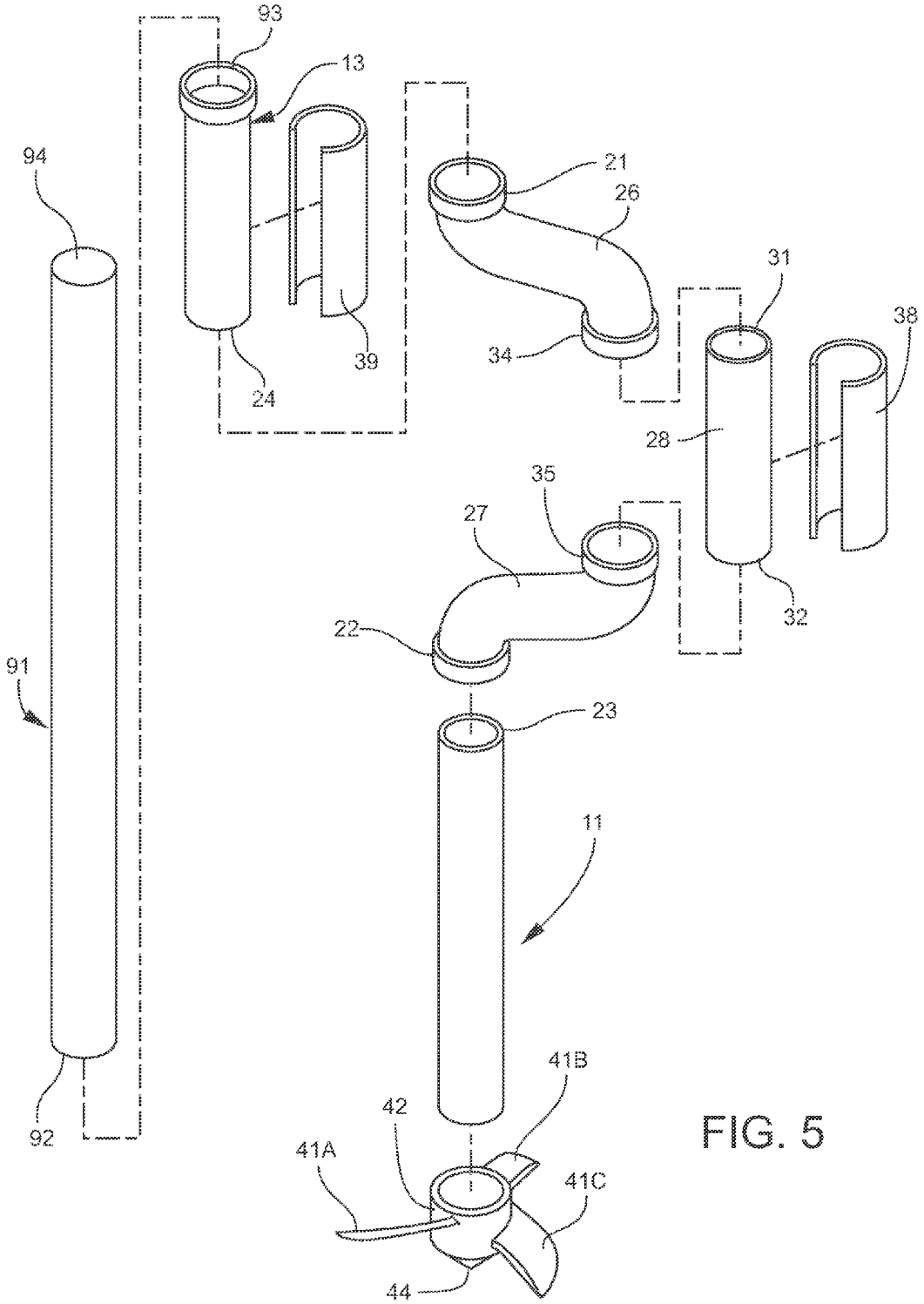
FIG. 5 is an exploded perspective view of the exemplary article holding device.

Referring to FIGS. 1, 2 and 5, the exemplary crank shaft 12 may be fabricated in multiple parts comprising first and second angled fittings 26, 27 and an intermediate crank handle 28—the shaft parts 26, 27, 28 being permanently joined together using (e.g.) a suitable plastic adhesive or hardware. The crank handle 28 is laterally offset from and substantially parallel to the ground shaft 11, and has opposing male ends 31, 32 designed to insert in respective slightly enlarged female ends 34, 35 of the angled fittings 26, 27.

A first swivel hand sleeve 38 is separately applied to the crank handle 28 and intended for being grasped by a first hand of a user, while a second swivel sleeve 39 is separately applied to the hand shaft 13 and intended for being simultaneously grasped by a second hand of the user. The swivel sleeves 38, 39 are formed independent of the crank handle 28 and hand shaft 13, such that upon manual operation of the holding device 10 (as described further below) all three shafts 11, 12, 13 turn simultaneously together as a single unit relative to the two swivel sleeves 38, 39. The exemplary swivel sleeves 38, 39 are fabricated of a resilient plastic polymer and are longitudinally split, as best shown in FIG. 5, to enable convenient snap-attachment to the crank handle 28 and hand shaft 13, respectively.

In the exemplary embodiment shown, the elongated ground shaft 11 of the holding device 10 comprises a plurality of angled or twisted blades 41A, 41B, 41C radiating from a central hub 42 located at a distal end of the shaft 11, such that each blade 41A, 41B, 41C forms part of a radiating helical (or advancing spiral) surface. The ground shaft 11 may also have a closed pointed end 44 formed with the central hub 42 to precisely locate the holding device 10, and to facilitate penetration into and through the ground surface. In alternative embodiments, the ground shaft 11 may comprise a radiating helical screw thread or other related structure capable of penetrating a ground surface when rotated.

Figure 6:
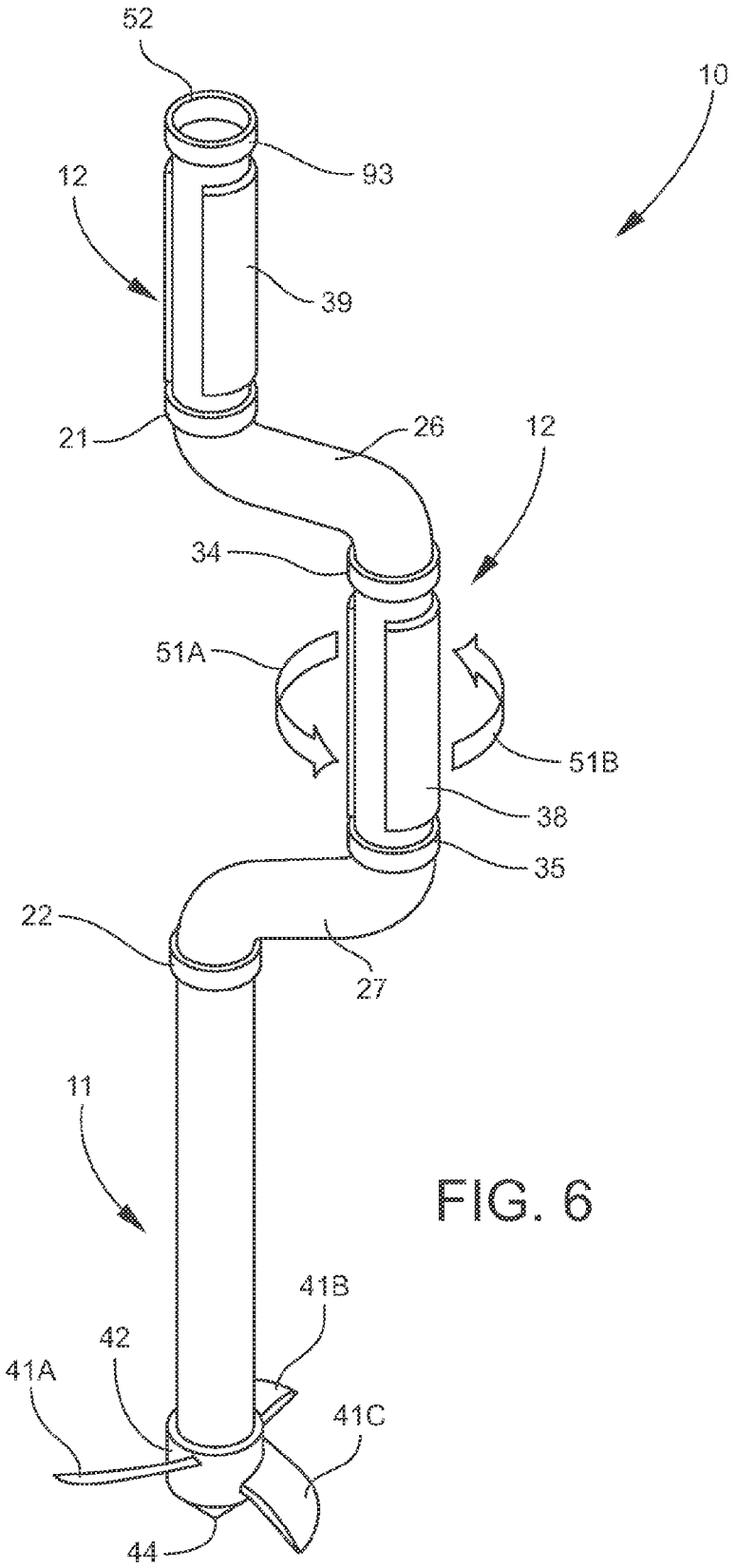
FIG. 6 is a perspective view of the exemplary article holding device, and showing direction arrows indicating the manual cranking-type motion for driving the device into and through the ground surface.

FIG. 6 demonstrates operation of the exemplary article holding device 10, and the working motion of the integrally joined shafts 11, 12, and 13. The user manually rotates the ground shaft 11 by grasping the first swivel sleeve 38 of the crank handle 28 and turning the crank shaft 12 in a cranking-type motion, as indicated by arrows 51A and 51B, while simultaneous grasping and holding the second swivel sleeve 39 of the hand shaft 13. The swivel sleeves 38, 39 allow free independent rotation of the integrally joined shafts 11, 12, 13 (indicated by arrow 52) as the ground shaft 11 penetrates the ground surface and is driven downward to a depth sufficient to enable the device 10 to securely hold the particular outdoor utility article.

FIGS. 7, 8, and 9 illustrate various exemplary uses of the article holding device 10 in combination with a beach umbrella 60, table 70, and fishing rod mount 80. Each of these utility articles 60, 70, 80 has an elongated mounting post "P" designed to fit into an open end of the holding device 10. For added support strength and stability, the exemplary holding device 10 may further comprise an elongated hollow extension shaft 91 (See FIGS. 5, 7, and 9) having a proximal male end 92 designed to insert into the open distal female end 93 of the hand shaft 13. The hand shaft 13 and extension shaft 91 may be permanently or removable joined together by complementary screw threads, an adhesive, friction fit, or any other suitable means. In the case of beach umbrella 60 and fishing rod mount 80, shown in FIGS. 7 and 9, the posts "P" insert into and through the open distal end 94 of the extension shaft 91 to securely hold the article 60, 80 above the ground surface. In the case of the table 70 shown in FIG. 8, the extension shaft 91 may be removed and the table post "P" inserted directly into the open female end 93 of the hand shaft 13.

In further alternative exemplary embodiments, the article holding device 10 may be integrated (or integrally formed) with the post of a beach umbrella or other outdoor utility article, such that the holding device and outdoor article comprise one single integrally joined unit. In this embodiment, the crank shaft and swivel hand sleeves may be located along any portion of the article post.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed:

1. An article holding device, comprising:

an elongated rigid ground shaft comprising a radiating helical surface, said helical surface being defined by a plurality of circumferentially spaced-apart propeller-like angled blades radiating from a central hub attached to said ground shaft;

a generally C-shaped crank shaft attached to said ground shaft, and comprising a crank handle attached to an upper and lower angled fitting, so that the crank handle is laterally offset from and substantially parallel to said ground shaft, and said upper and lower angled fittings comprising longitudinally spaced-apart enlarged annular female ends and a first swivel sleeve located between the enlarged female ends attached to said crank handle and adapted for being grasped by a first hand of a user, and said first swivel sleeve being fabricated of resilient material and longitudinally split for enabling snap-on attachment to said crank handle;

an elongated hand shaft attached to said crank shaft opposite said ground shaft and comprising longitudinally spaced-apart enlarged annular female ends, and said hand shaft further comprising a second swivel sleeve located between the enlarged annular female ends of said hand shaft and adapted for being grasped by a second hand of the user, and said second swivel sleeve being fabricated of resilient material and longitudinally split for enabling snap-on attachment to said hand shaft, whereby the user manually rotates said ground shaft by grasping the first swivel sleeve of said crank handle and turning said crank shaft, while simultaneous grasping and holding the second swivel sleeve of said hand shaft, thereby driving the helical surface of said ground shaft into and through a penetrable ground surface; and means adjacent a free end of said hand shaft for holding an outdoor utility article.

2. The article holding device according to claim 1, wherein said ground shaft has a substantially closed pointed end.

3. The article holding device according to claim 1, wherein said means for holding the utility article comprises an elongated substantially hollow extension shaft adjacent said hand shaft, and defining an open end for receiving a mounting post of the utility article.

4. The article holding device according to claim 1, wherein said ground shaft, crank shaft, and hand shaft are integrally joined together, and rotate as single unit upon manual rotation of said crank shaft.

5. The article holding device according to claim 1, wherein said first swivel sleeve is formed independent of said crank handle, such that said crank shaft turns freely relative to said first swivel sleeve.

6. The article holding device according to claim 1, wherein said second swivel sleeve is formed independent of said hand shaft, such that said hand shaft turns freely relative to said second swivel sleeve.

7. The article holding device according to claim 1, wherein said hand shaft is substantially hollow, and defines an open end for receiving a mounting post of the outdoor utility article.

8. The article holding device according to claim 1, wherein said ground shaft, crank shaft, and hand shaft are fabricated of a rigid synthetic plastic polymer.

9. In combination with an outdoor utility article comprising a mounting post, an article holding device adapted for supporting said utility article above a ground surface, said article holding device comprising:

an elongated rigid ground shaft comprising a radiating helical surface, said helical surface being defined by a plurality of circumferentially spaced-apart propeller-like angled blades radiating from a central hub attached to said ground shaft;

a generally C-shaped crank shaft attached to said ground shaft, and comprising a crank handle attached to an upper and lower angled fitting, so that the crank handle is laterally offset from and substantially parallel to said ground shaft, and said upper and lower angled fittings comprising longitudinally spaced-apart enlarged annular female ends and a first swivel sleeve located between the enlarged female ends attached to said crank handle and adapted for being grasped by a first hand of a user, and said first swivel sleeve being fabricated of resilient material and longitudinally split for enabling snap-on attachment to said crank handle;

an elongated hand shaft attached to said crank shaft opposite said ground shaft, and comprising longitudinally spaced-apart enlarged annular female ends, said hand shaft further comprising a second swivel sleeve located between the enlarged annular female ends of said hand shaft and adapted for being grasped by a second hand of the user, and said second swivel sleeve being fabricated of resilient material and longitudinally split for enabling snap-on attachment to said hand shaft, whereby the user manually rotates said ground shaft by grasping the first swivel sleeve of said crank handle and turning said crank shaft, while simultaneous grasping and holding the second swivel sleeve of said hand shaft, thereby driving the helical surface of said ground shaft into and through a penetrable ground surface; and means adjacent a free end of said hand shaft for holding the mounting post of said utility article.

10. The combination according to claim 9, wherein said ground shaft has a substantially closed pointed end.

11. The combination according to claim 9, wherein said means for holding the utility article comprises an elongated substantially hollow extension shaft adjacent said hand shaft, and defining an open end for receiving the mounting post of said utility article.

12. The combination according to claim 9, wherein said ground shaft, crank shaft, and hand shaft are integrally joined together, and rotate as single unit upon manual rotation of said crank shaft.

13. The combination according to claim 9, wherein said first swivel sleeve is formed independent of said crank handle, such that said crank shaft turns freely relative to said first swivel sleeve.

14. The combination according to claim 9, wherein said second swivel sleeve is formed independent of said hand shaft, such that said hand shaft turns freely relative to said second swivel sleeve.

15. The combination according to claim 9, wherein said hand shaft is substantially hollow, and defines an open end for receiving the mounting post of said outdoor utility article.

16. The combination according to claim 9, wherein said outdoor utility article is selected from a group consisting of an umbrella, a table top, and a fishing rod holder.

17. The article holding device according to claim 9, wherein said ground shaft, crank shaft, and hand shaft are fabricated of a rigid synthetic plastic polymer.

* * * * *